United States Patent [19]

O'Boyle et al.

[11] Patent Number: 4,646,746

[45] Date of Patent: Mar. 3, 1987

[54] BRASSIERE SUPPORT ELEMENT

[75] Inventors: Dolores O'Boyle, Woodridge, N.J.; William C. Hittel, New Hyde Park, N.Y.

[73] Assignee: International Playtex, Inc., Stamford, Conn.

[21] Appl. No.: 779,713

[22] Filed: Sep. 24, 1985

Related U.S. Application Data

[63] Continuation of Ser. No. 634,348, Jul. 25, 1984, Pat. No. 4,558,705.

[51] Int. Cl.[4] ..... A47C 1/14

[52] U.S. Cl. ..... 128/476

[58] Field of Search ..... 128/476, 469

[56] References Cited

U.S. PATENT DOCUMENTS

| | | | |
|---|---|---|---|
| Re. 22,771 | 7/1946 | Licht . | |
| 1,798,274 | 3/1931 | Pons . | |
| 2,438,062 | 3/1948 | Licht . | |
| 2,454,152 | 11/1948 | Glick . | |
| 2,480,049 | 8/1949 | Rosenberg . | |
| 2,506,639 | 5/1960 | Gordon . | |
| 2,509,353 | 5/1950 | Johnson . | |
| 2,530,829 | 11/1950 | Licht . | |
| 2,541,147 | 2/1951 | Becker . | |
| 2,649,586 | 8/1953 | Josephson . | |
| 2,761,147 | 9/1956 | Gluckin . | |
| 2,773,265 | 12/1956 | Dick . | |
| 2,824,563 | 2/1958 | Hill . | |
| 2,883,988 | 4/1959 | Lee . | |
| 3,030,633 | 4/1962 | Chalfin . | |
| 3,126,007 | 3/1964 | Jonas | 128/476 |
| 3,195,541 | 7/1965 | Zurkowski . | |
| 3,528,430 | 9/1970 | Child . | |
| 3,531,807 | 10/1970 | DeVito et al. . | |
| 3,562,802 | 2/1971 | Avis | 128/469 |
| 3,747,606 | 7/1973 | Tareau . | |
| 3,750,673 | 8/1973 | Penrock . | |
| 3,777,763 | 12/1973 | Schwartz . | |
| 3,799,175 | 3/1974 | Rowell . | |

*Primary Examiner*—Doris L. Troutman

*Attorney, Agent, or Firm*—Stewart J. Fried; Charles N. J. Ruggiero

[57] ABSTRACT

A plastic support which has a substantially U-shape configuration and has a base portion and a pair of end portions with the base portion and the end portions having a different cross-sectional configuration. The plastic support also has a pair of regions positioned between the base portion and a different one of the pair of end portions, and in a preferred embodiment the pair of regions is a pair of intermediate portions each having a cross-sectional configuration different than that of the base portion and the pair of end portions. The plastic support is, preferably, made of a mixture of reinforced acetal rein and nonreinforced acetal resin, and exhibits unexpected "creep" properties such that the end portions thereof are closer together after machine laundering at a normal cycle than their initial condition.

4 Claims, 10 Drawing Figures

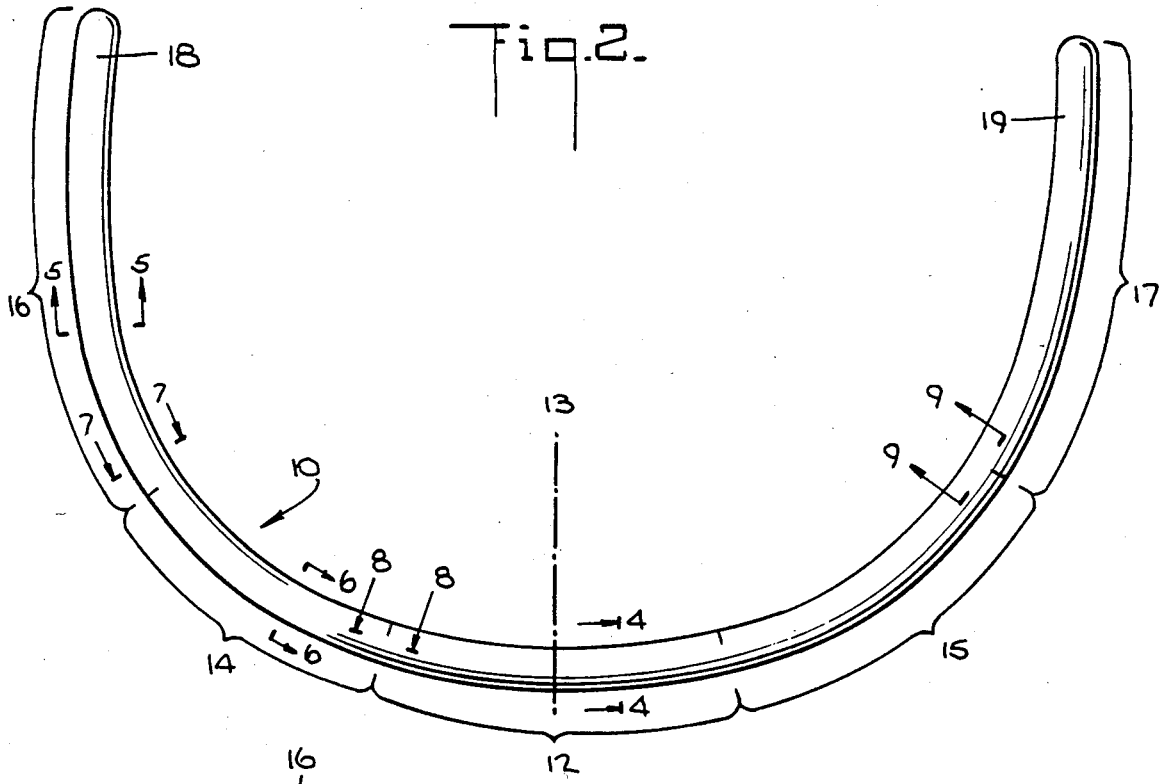
Fig. 2.
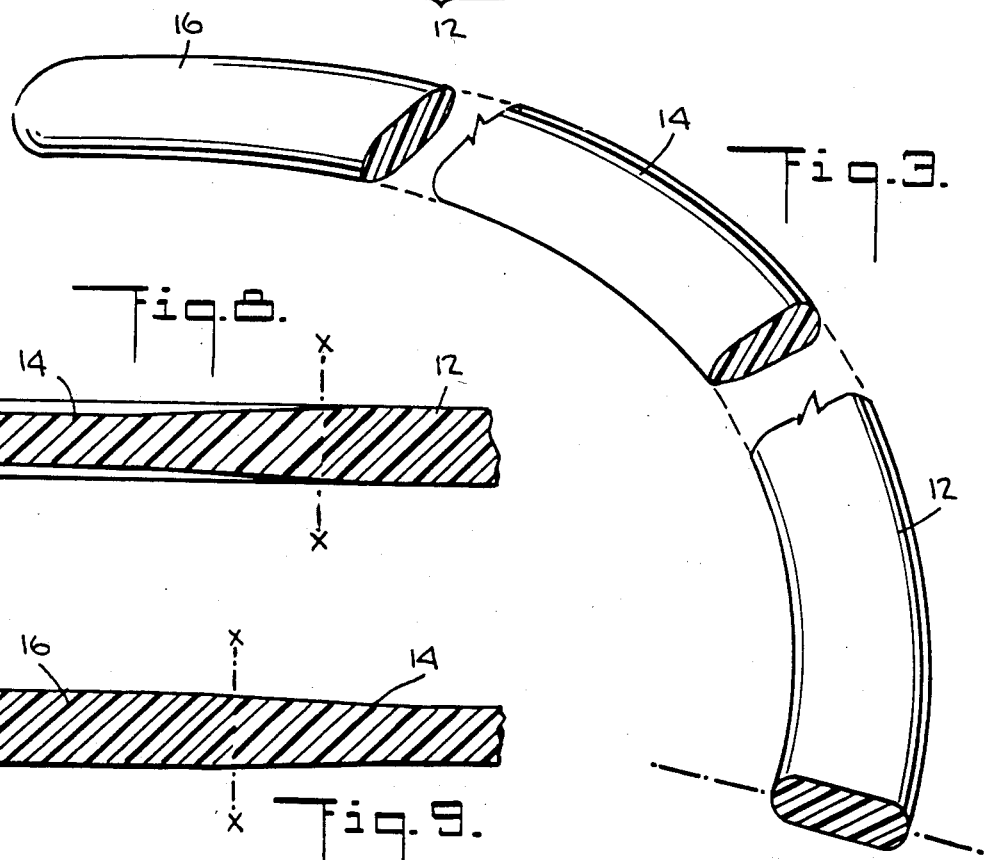
Fig. 3.
Fig. 8.
Fig. 9.

BRASSIERE SUPPORT ELEMENT

This is a continuation application of Ser. No. 634,348, filed July 25, 1984, now U.S. Pat. No. 4,558,705, which issued Dec. 17, 1985.

BACKGROUND OF THE INVENTION

The present invention relates to a support used in association with a cup of a brassiere and, more particularly, to a plastic substantially U-shape undercup support which has preselectively different cross-sectional configurations along its length.

1. Field of the Invention

A support, a stay or an underwire is desired in some types of brassieres to provide upward support for the cup of the brassiere. The upward support can reduce the strain on the shoulders of the brassiere wearer, and enough upward support can be provided so that the brassiere may not need shoulder straps or, at least, will need less support from the shoulder straps. Further, the upward support enhances the shape of the brassiere and, therefore, the features of the wearer.

2. Description of Related Art

Metal underwires, and in particular substantially U-shape metal underwires, are so universally used in brassieres that this type of brassiere is generally know as an underwire brassiere; however, such area art underwire brassieres have certain shortcomings. Specifically, a metal underwire has little resilence and, therefore, easily twists or distorts out of shape which distortion causes discomfort to the wearer. Accordingly, to minimize distortion, brassiere manufacturers have recommended that their metal underwire brassieres not be machine laundered. In addition, machine laundering causes the end portions of a metal underwire to damage the stitching of the sheath or pocket of material in which the metal underwire is typically enclosed in the brassiere frame so that the metal underwire will "poke-through" the brassiere. Hand laundering, which is required to avoid this, is inconvenient to the consumer. Only recently has a manufacturer of a metal underwire brassiere even suggested machine laundering and this provided the machine laundering is at a gentle, or special, cycle. However, gentle cycle laundering is inconvenient and time consuming. Specifically, gentle cycle laundering has both slower spin and milder agitation features than a normal cycle laundering, and therefore the gentle cycle laundering is not suitable for heavily soiled garments. Accordingly, gentle cycle laundering is normally limited to delicate type garments since they are not heavily soiled. Further, a relatively smaller number of garments can be laundered during gentle cycle as compared to the number laundered during normal cycle.

Some stays and supports have been made of plastic. However, a plastic support is much weaker than its similarly configurated metal underwire. Accordingly, the plastic support needs to be made of a material and of a configuration which provides enough rigidity at the portion thereof under the breast of the wearer. However, such rigidity is not desired at the end portions of the plastic support since such rigidity will cause the end portions to rub against and thereby irritate the wearer as the wearer moves.

Prior art plastic stays and supports have taken various measures to provide the desired rigidity and yet avoid having the end portions thereof irritate the wearer. Such measures are found in the following patents.

U.S. Pat. No. 3,030,633 to Chalfin is directed to plastic strips which, in certain embodiments thereof, have a body portion and tip portions of different resiliency since the tip portions are made from a softer resin material and of a thickness less than that of the body portion. The tip portions also include notches which are provided to sew the strip in place in the brassiere.

U.S. Pat. No. 3,737,606 to Tareau is directed to a U-shape plastic stay which can be made from any one of a variety of cross-sections and which has an aperture in one end thereof for fastening the stay to the brassiere and a joint in the other end thereof for fastening the stay to another stay.

U.S. Pat. No. 3,777,763 to Schwartz and U.S. Pat. No. 3,884,244 to Rowell are directed to U-shape plastic supports which preferably are of a rectangular cross-sectional configuration. The Schwartz patent provides that the terminal end closest to the arm of the wearer is twisted out of the plane of the remainder of the support, while the Rowell patent provides a dished-out contour, i.e. the base area of the support is bent slightly forward out of the plane of the end portions and the inner peripheral edge is angularly offset from the outer peripheral edge, and end portions which may have enlarged knobs to substantially reduce or preclude abrasion of the end portions.

However, such measures have made the brassiere costly to manufacture, have not completely eliminated stress from being applied to the wearer by the end portions of the support and/or the side panels of the brassiere, and further many of such prior art plastic supports and stays do not provide adequate support and comfort.

SUMMARY OF THE INVENTION

An object of the present invention is to provide a plastic undercup support for use in association with a cup of a brassiere which plastic support provides the wearer with adequate support and yet sufficient flexibility so that the brassiere is comfortable to the wearer.

Another object of the present invention is to provide a plastic support for use in association with a cup of a brassiere which plastic support enables the brassiere to have support and flexibility and retain its shape, even after repeated machine laundering at normal cycles.

A further object of the present invention is to provide a plastic support for use in association with a cup of a brassiere which plastic support retains its resiliency and resists "poke-through" the brassiere pocket even though it is not directly sewn into place in the brassiere, even after the brassiere has been repeatedly machine laundered at normal cycles.

A still further object of the present invention is to provide a plastic, substantially U-shape configurated support for use in association with a cup of a brassiere which plastic support exhibits the support enhancing property of "creep" such that after machine laundering at a normal cycle and end portions of the support are closer together than their initial condition, i.e. prior to the support being used.

A still further object of the present invention is to provide a plastic, substantially U-shape configurated support for use in association with a cup of a brassiere which plastic support has different cross-sectional configurations along its length so as to provide improved resiliency in the arc and flexibility in the end portions thereof.

A still further object of the present invention is to provide a plastic, substantially U-shape configurated support for use in association with a cup of a brassiere which plastic support is made of a combination of reinforced and nonreinforced acetal resins.

A still further object of the present invention is to provide a plastic, substantially U-shape configurated support for use in association with a cup of a brassiere which plastic support is made of a combination of acetal resins and of different cross-sectional configurations so as to provide improved resiliency in the arc and flexibility in the end portions thereof and will retain these features even after repeated use and repeated machine laundering at normal cycles, and which even after repeated machine laundering at normal cycles, returns at least to its original shape.

These and other objects of the present invention are provided for by a plastic, substantially U-shape configurated support which has, preferably, three different cross-sectional configurations along its length. Specifically, the support includes in a preferred embodiment thereof, a base portion of an arcuate-edged rectangular cross-sectional configuration, a pair of intermediate portions each adjacent a different end of the base portion and having a tear-drop cross-sectional configuration, and end portions each being adjacent a different intermediate portion and of an elliptical cross-sectional configuration. The plastic support is, preferably, made of a one to one mixture of reinforced and nonreinforced acetal resins.

BRIEF DESCRIPTION OF THE DRAWINGS

FIG. 2 is a front elevational view of the plastic support of the present invention.

FIG. 3 is an exploded perspective view of a portion of the plastic support of the present invention.

FIG. 8 is a cross-section taken along 8—8 of FIG. 2.

FIG. 9 is a cross-section taken along 9—9 of FIG. 2.

DESCRIPTION OF THE PREFERRED EMBODIMENTS

Figure 1:
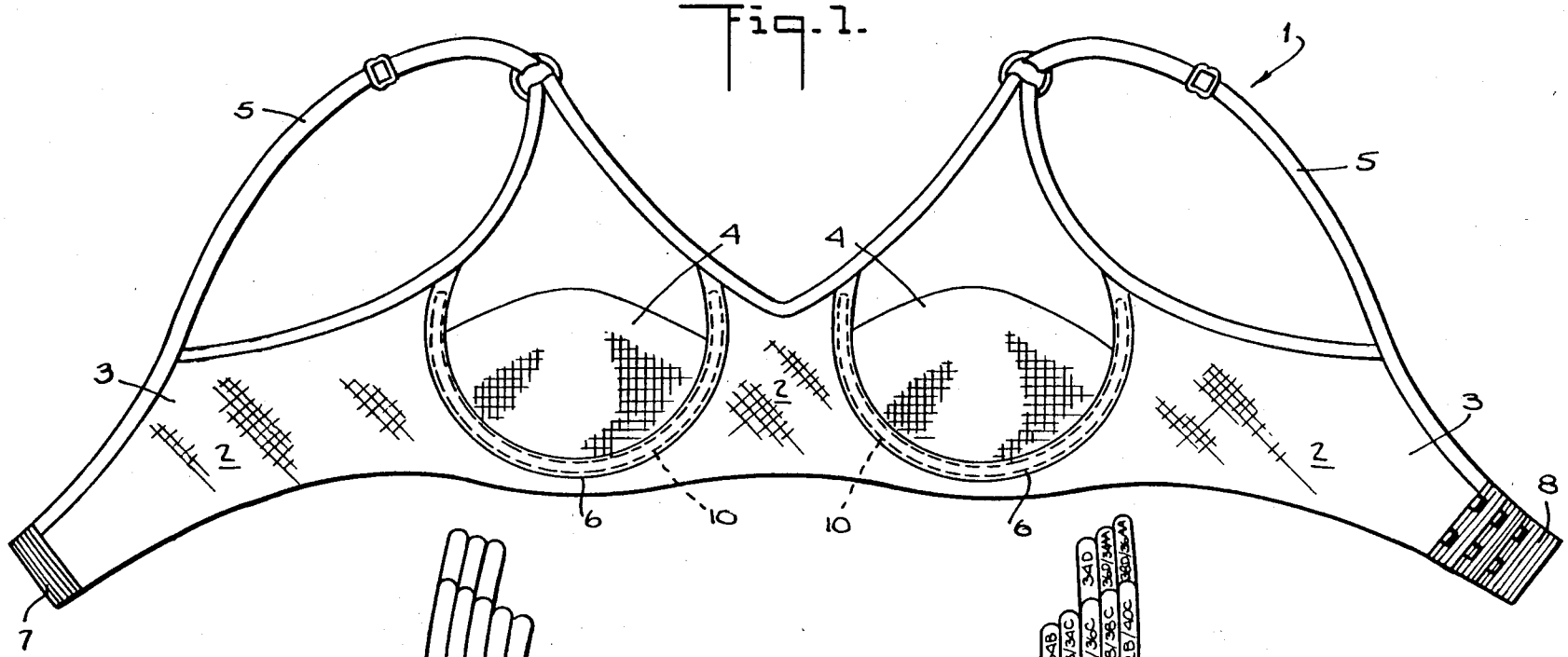
FIG. 1 is a front elevational view of a brassiere frame having a pair of the plastic U-shape configurated supports of the present invention therein.

Referring to the drawings and more particularly to FIG. 1, a brassiere, generally represented by reference numeral 1, includes a frame 2, having a pair of body encompassing side panels 3, a pair of breast receiving cups 4 sewn to a front portion of a different one of the pair of side panels, a pair of shoulder straps 5 each associated with a different one of the pair of side panels, and closure means preferably in the form of a hook 7 and eye 8 arrangement at the distal ends of the side panels. There is also provided a pair of material strips 6 each sewn to a different one of the pair of side panels 3 so that each panel and its respective strip defines an enclosed housing. Each housing is located along the lower edge and sides of a different one of the pair of cups, and is designed to provide a pocket to enclose a plastic support 10.

Referring to FIG. 2, plastic support 10 is an integral structure, preferably molded, and has a substantially U-shape configuration. The arc of the U-shape support has a large radius, and may, preferably, be constructed with tip portions 18, 19 which are biased slightly towards each other to more readily conform to the features of a wearer.

Each plastic support 10 has different cross-sectional configurations along its length to meet the different rigidity and flexibility requirements of the different portions of a support. By way of background, a support having a rectangular cross-section provides a great deal of support or rigidity, however it is bulky and has little flexibility. Likewise, a support having a trapezoidal cross-section also provides a great deal of support, but also is bulky and has limited flexibility. Further, the rectangular and trapezoidal cross-sectional supports may possibly irritate the wearer unless their edges are modified. In contradistinction, a support having an elliptical cross-section is not bulky and is flexible, however it is not very rigid so that in a U-shape configuration the arc area will have a tendency to flatten out. Likewise, a support having an oval or a tear-drop cross-section basically exhibits the same characteristics as an elliptical cross-section support but is less flexible. Supports having other cross-sectional configurations, such as "I", "L" and round shapes, also do not provide both a great deal of support, which is needed in the arc portion of a U-shape support, and a great deal of flexibility, which is desired in the end portions of a U-shape support.

Figure 4:
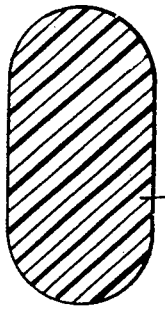
FIG. 4 is a cross-section taken along 4—4 of FIG. 2.
Figure 5:
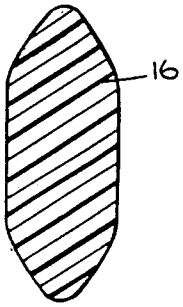
FIG. 5 is a cross-section taken along 5—5 of FIG. 2.

As shown in FIG. 2, plastic support 10 has one cross-sectional configuration at a base portion 12, and another cross-sectional configuration at end portions 16,17. Base portion 12, which is at the arc of the support, has substantially either a rectangular or a trapezoidal cross-sectional configuration, with arcuate edges. Preferably it is rectangular with arcuate edges as shown in FIG. 4, to provide maximum support at this region of the arc. The arcuate edges are shaped to avoid irritating the wearer of the brassiere. End portions 16,17, include tip portions 18,19, respectively, which may have an elliptical, oval or tear-drop cross-sectional configuration. Preferably it is elliptical as shown in FIG. 5, to provide maximum flexibility.

When the brassiere is placed on the wearer, the end portions 16,17 spread outward, i.e. away from each other, opening the arc, so as to fit comfortably and securely about the features of the wearer, i.e. without stress or discomfort or poking into the body of the wearer, while also providing adequate support.

There is also provided regions 14,15 which are located between base portion 12 and end portions 16,17, respectively, to connect the base portion to the respective end portion. These regions as shown in FIG. 2, preferably, have a third or tear-drop cross-sectional configuration which provides flexibility to effect a gradual structural and flexibility/rigidity transition from the differently configurated base 12 and end portions 16,17 of the plastic support as shown in FIGS. 8 and 9. Alternatively, regions 14,15, each may simply be a zone, analogous to the zone indicated by line X—X in FIGS. 8 and 9, in which base portion 12 and end portions 16,17 are blended together so that the plastic support has only two different cross-sectional configurations along its length. In this embodiment, base portion may have either a rectangle or a trapezoidal, arcuate-edged, cross-sectional configuration, and end portions 16,17, preferably, have either a tear-drop or an elliptical cross-sectional configuration.

FIG. 3 illustrates the different cross-sectional configurations of the preferred embodiment of the present invention in which base portion 12 has a rectangular arcuate edged cross-sectional configuration, regions 14,(15) are intermediate portions each having a tear-drop cross-sectional configuration, and end portions 16,(17) have an elliptical cross-sectional configuration. In a 34B size plastic support 10, which size is customarily used in the brassiere manufacturing industry, the preferred embodiment of the present invention has the following approximate cross-sectional dimensions (in a 0.190 gauge): base portion 12 is about 0.095 inches, end portions 16,17 is about 0.080 inches, and intermediate portions 14,15 vary between the cross-sectional dimension of the base portion and the end portions, i.e. about from 0.080 to 0.095 inches.

Figure 6:
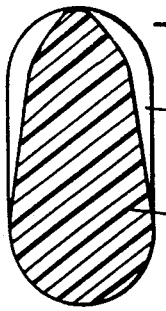
FIG. 6 is a cross-section taken along 6—6 of FIG. 2.
Figure 7:
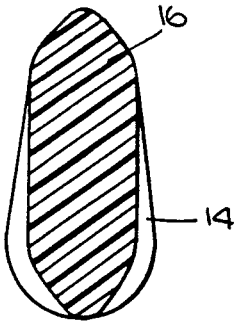
FIG. 7 is a cross-section taken along 7—7 of FIG. 2.

Further, FIG. 6 is provided to illustrate the difference in the configurations of the tear-drop cross-sectional intermediate portion or region 14 and the trapezoidal cross-sectional base portion 12. Likewise, FIG. 7 is provided to illustrate the difference in the configurations of the elliptical cross-sectional end portion 16 and intermediate portion 14.

Referring again to FIG. 2, to provide further comfort to the wearer while simultaneously minimizing bulkiness, the start of the transition from the base portion to the intermediate portion or region and from the intermediate portion to the end portion may vary depending whether the end portion of the plastic support 10 is located closer to either the front, i.e. near the breasts, or the back, i.e. near the underarms, of the wearer. The reason for this is that the front of the brassiere is more stable, i.e. there is less flexing and pulling thereat, than at the back of the brassiere; and therefore, the front of the brassiere has more control and accordingly needs less control assistance from plastic support 10. Specifically, dotted line 13 is the median of base portion 12. If end portion 16 will be located toward the front of the wearer, the start of the transition from base portion 12 to intermediate portion or region 14 and, in turn, from intermediate portion 14 to end portion 16 will be closer to median 13 than the start of the transition from base portion 12 to intermediate portion or region 15 and in turn intermediate portion 15 to end portion 17.

Base portion 12 is of an extent sufficiently large enough to support in a cradling manner the breast of the wearer yet as small as possible to minimize the bulk of the support.

Likewise, regions 14,15 will be only of an extent sufficient to support the breast of the wearer. The gauge of plastic support 10, as well as the nature of the plastic, effects the extent of the base portion, and therefore the extents of the intermediate and end portions. In a 34B size (0.190 gauge) plastic support 10, the preferred embodiment has base portion 12 of an extent of approximately $1\frac{1}{2}$ inches, intermediate portions 14,15 of extents of approximately 1 3/16, 1 5/16 inches, respectively, and end portions 16,17 of extents of approximately 2, $1\frac{3}{4}$ inches, respectively. Specifically, the smaller the gauge of plastic support 10, the larger the extent of the base portion which is needed to support in a cradling manner the breast of the wearer.

Figure 10:
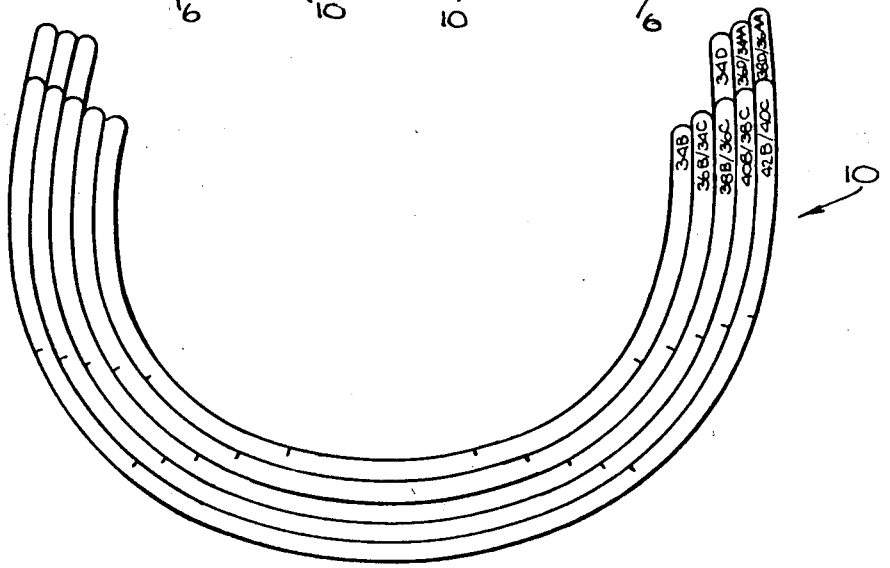
FIG. 10 illustrates grading of the plastic support of the present invention for different cup sizes.

Once the extents of the base portion, intermediate portions or regions, and end portions are determined for one size of a certain gauge of a plastic support, the extents of those portions for other sized plastic supports of the same gauge can easily be determined as illustrated in FIG. 10. Therefore, the plastic support of the present invention can be used in a variety of different gauges and can readily be used in different sizes of each gauge, thereby making the plastic support of the present invention conducive to a large number of brassiere sizes and types.

The type of plastic used to make support 10 is significant since the plastic needs to be light in weight, strong yet flexible, resilient, and resistant to water, solvents, and chemicals found in liquid detergents. It has been found particularly desirable for plastic support 10 to be made of a molded plastic selected from the group including nylons, acetal resins and polyesters, and mixtures thereof, and the plastic may be reinforced by glass fillers which gives strength to the plastic and does not make the plastic brittle if applied in limited amounts. The plastic is, preferably, made from a mixture of reinforced acetal resins, i.e. acetal resin with glass fillers, and nonreinforced acetal resin, i.e. acetal resin without glass fillers, and is, most preferably, made of a one to one mixture of nonreinforced acetal resin (without glass fillers), such as that sold by E I du Pont de Nemours, Inc. under their trademark Delrin® 500, and reinforced acetal resin having glass fillers which amount to appropriately thirty-three percent of the total weight of the reinforced acetal resin, such as that also sold by E I du Pont de Nemours, Inc. under their trademark Delrin® 570.

Figure 11:
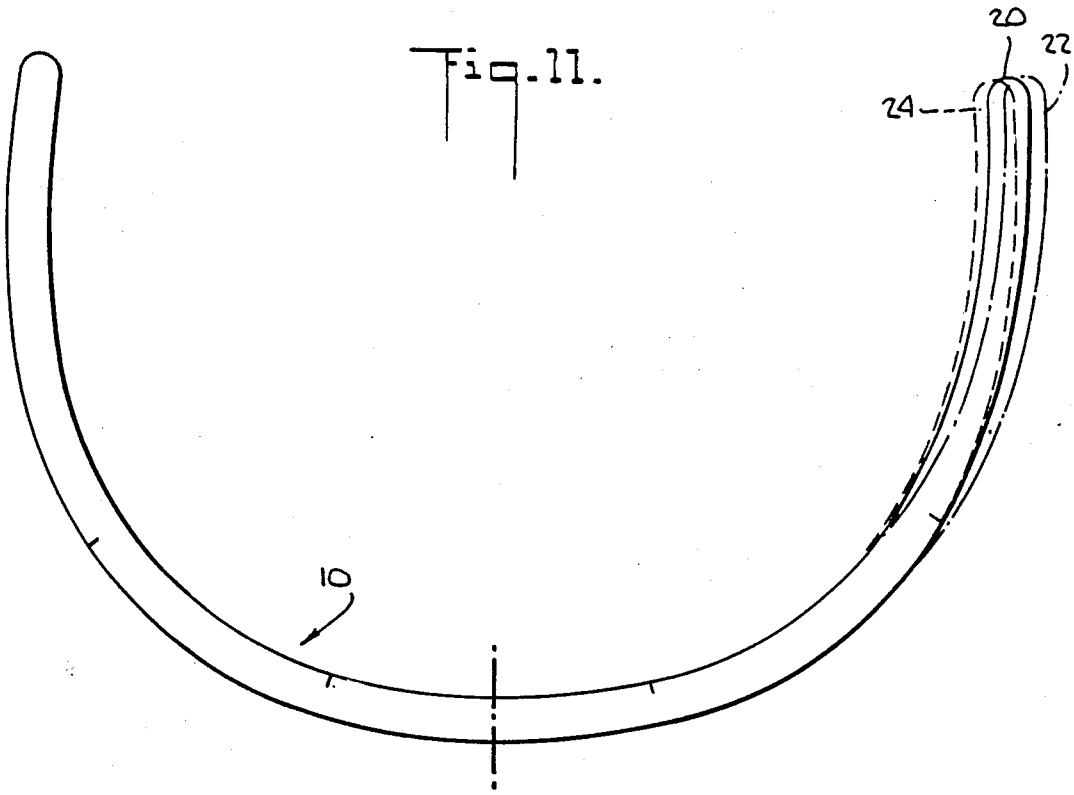
FIG. 11 is a sketch illustrating "creep" in the plastic support of the present invention.

Plastic supports of the present invention, which have the U-shape configuration with three cross-sectional configurated portions and made of the reinforced acetal resin-nonreinforced acetal resin compositions set forth above, have exhibited unexpected "creep" characteristics. "Creep" as defined in the present invention means a gradual drawing together of end portions 16,17 of the U-shape plastic support 10, which drawing together tightens the arc of the plastic support. Specifically, the end portions of a U-shape plastic support tend to spread away from each other after being used, due to the body heat and weight of the wearer. Spreading away of end portions 16,17 opens up the arc. While an initial slight spreading is desired so that the brassiere will readily conform to the features of the wearer, the brassiere will lose its shape and support, and accordingly the wearer will lose the feeling of support and therefore confidence in the brassiere, if the degree of the spread is too great. Logically, one would assume that machine laundering at normal cycles of a brassiere having a plastic U-shape configurated support would result in an increase in the degree of spread of the plastic support thereof due to the hot water employed in the normal cycles. However, the plastic support of the present invention has exhibited unexpected "creep" characteristics which further tend to make the brassiere retain its support and shape. While both end portions 16 and 17 exhibit the same "creep" characteristics, FIG. 11 illustrates the characteristics of "creep" with respect to only one end portion 17 of plastic support 10. Specifically, after wear, end portion 17 of plastic support 10, which end portion initially is at position 20, spreads outward to position 22. It has been found that after machine laundering at a normal cycle, the end portion 17 not only returns to its initial position 20, but continues inward slightly further to position 24. The "creep" characteristic of plastic support 10 of the present invention assures that the brassiere will at least return to its initial shape a great number of times for a longer period of time so that the wearer is provided with the same support, and also the same feeling of support, shaping and confidence, as provided before the brassiere was worn or laundered. Since the end portions of plastic support 10 of the present invention are flexible, when the brassiere is placed on the wearer, the "creep" can easily be accommodated so that the plastic support of the present invention will not cause the wearer discomfort.

Although certain embodiments have been described and illustrated, modification may be made, as by adding, combining, subdividing parts of substituting equivalents while retaining the advantages and benefits of the present invention which is defined in the following claims.

We claim:

1. A plastic substantially U-shape, integral support for use in conjunction with a breast cup of a brassiere, said support comprising:

a base portion located at the arc of the U-shape and having a substantially rectangular cross-sectional configuration;

a pair of end portions, each end portion associated with a different end of said base portion and having a tear-drop cross-sectional configuration; and a pair of regions each positioned between said base portion and a different one of said end portions to connect said base portion and said respective end portion.

2. The support according to claim 1, wherein said base and end portions are discrete, continuous, cross-sectional segments.

3. A plastic substantially U-shape, integral support for use in conjunction with a breast cup of a brassiere, said support comprising:

a base portion located at the arc of the U-shape and having substantially rectangular cross-sectional configuration;

a pair of end portions, each end portion associated with a different end of said base portion and having an elliptical cross-sectional configuration; and a pair of regions each positioned between said base portion and a different one of said end portions to connect said base portion and said respective end portion.

4. The support according to claim 3, wherein said base and end portions are discrete, continuous cross-sectional segments.

* * * * *